United States Patent [19]

Erickson

[11] 4,359,825

[45] Nov. 23, 1982

[54] DRAFTING MACHINE ATTACHMENT

[76] Inventor: Jerroll C. Erickson, 3912 Joyce Ave., Powell River, British Columbia, Canada

[21] Appl. No.: 241,608

[22] Filed: Mar. 9, 1981

[51] Int. Cl.[3] ..... B43L 13/02

[52] U.S. Cl. ..... 33/438; 33/441; 33/174 B

[58] Field of Search ..... 33/438, 439, 440, 441, 33/442, 443, 250, 174 B, 429, 484, 485, 490, 491

[56] References Cited

U.S. PATENT DOCUMENTS

| | | | |
|---|---|---|---|
| 1,345,653 | 7/1920 | Wallenstein | 33/174 B |
| 1,529,478 | 3/1925 | Irisch | 33/174 B |
| 1,611,140 | 12/1926 | Conti | 33/174 B |
| 1,672,751 | 6/1928 | Conti | 33/174 B |
| 1,794,648 | 3/1931 | Shattow | 33/438 |
| 2,033,715 | 3/1936 | Jacob | 33/441 |
| 2,622,333 | 12/1952 | Magnuson | 33/174 B |
| 2,746,157 | 5/1956 | Langford | 33/174 B |
| 2,858,612 | 11/1958 | Verrett | 33/476 |
| 3,103,747 | 9/1963 | De La Sierra | 33/174 B |
| 3,375,588 | 4/1968 | Pelham | 33/438 |
| 3,568,327 | 3/1971 | Furuoka | 33/174 B |
| 3,813,787 | 6/1974 | Mercorelli | 33/174 B |

*Primary Examiner*—Willis Little

*Attorney, Agent, or Firm*—Beehler, Pavitt, Siegemund, Jagger & Martella

[57] ABSTRACT

An attachment for a drafting machine having a protractor head has a scale which is securable to the head. By operation of the head, the scale is movable on the drawing board between a first position and a second position disposed at a predetermined acute angle to the first position. On the ruling edge of the scale, there is an index point which is usable when the scale is in the first position to mark the location for the placement of a required symbol. A template is mounted below the scale for rotation about an axis perpendicular to the drawing board and this template is provided with a plurality of outlines which serve as stencils for applying symbols to a drawing. An indicator on the structure supporting the template enables a particular symbol outline to be selected and placed in a position which will coincide with the marked location when the scale is moved to the second position.

9 Claims, 6 Drawing Figures

DRAFTING MACHINE ATTACHMENT

BACKGROUND OF THE INVENTION

This invention relates generally to the field of drawing aids and more particularly to a device which is attachable to a drafting machine for use in applying symbols to a drawing.

There are a great number of stencil-type aids available to a draftsman who is required to repeatedly apply certain shapes and symbols to a drawing. These usually take the form of a draft square, for example, which is a square of clear plastic or the like having openings shaped to provide stencils of the various shapes required. A draftsman working on an electrical drawing requires a set of such templates while other sets are required for piping layouts, welding drawings and so on. The proper selection and placement of such templates takes up an undesirable amount of the draftsmans time and often they cannot be used effectively within the modern parallel-motion drafting machine.

Attempts have been made to provide drafting machine attachments which will aid in the application of symbols and such devices are suitable when a relatively small number of symbols or the like are to be applied to a drawing but a draftsman expected to turn out a variety of work with speed and accuracy generally finds such symbol-applying aids time-consuming and awkward to use. As a result, many draftsmen resort to stencils which are not attachable to the machine and these do little to assist in locating the place on the drawing to apply a particular symbol.

SUMMARY OF THE INVENTION

The present invention is a new and improved drafting aid which overcomes the problems inherent in the prior art devices by providing an attachment for a drafting machine of the type which is mountable on a drawing board and has a protractor head fitted with a chuck. The attachment makes it a relatively simple matter to locate and mark the place on a drawing where a symbol is required. Once this is done, the required symbol on a template provided on the attachment is moved by rotation of the template into an indexed position. This position is related to the marked location for the symbol so that, by operating the protractor head of the drafting machine to swing the attachment a known number of degrees away from the marked location, the selected symbol outline on the template comes into register with the mark and that symbol can then be drawn. The attachment is equipped with sets of templates provided with a great variety of symbols and a quick-coupling arrangement enables a selected template to be quickly and easily fitted in a position of use on the attachment.

DESCRIPTION OF THE PREFERRED EMBODIMENTS

Figures 1, 2:
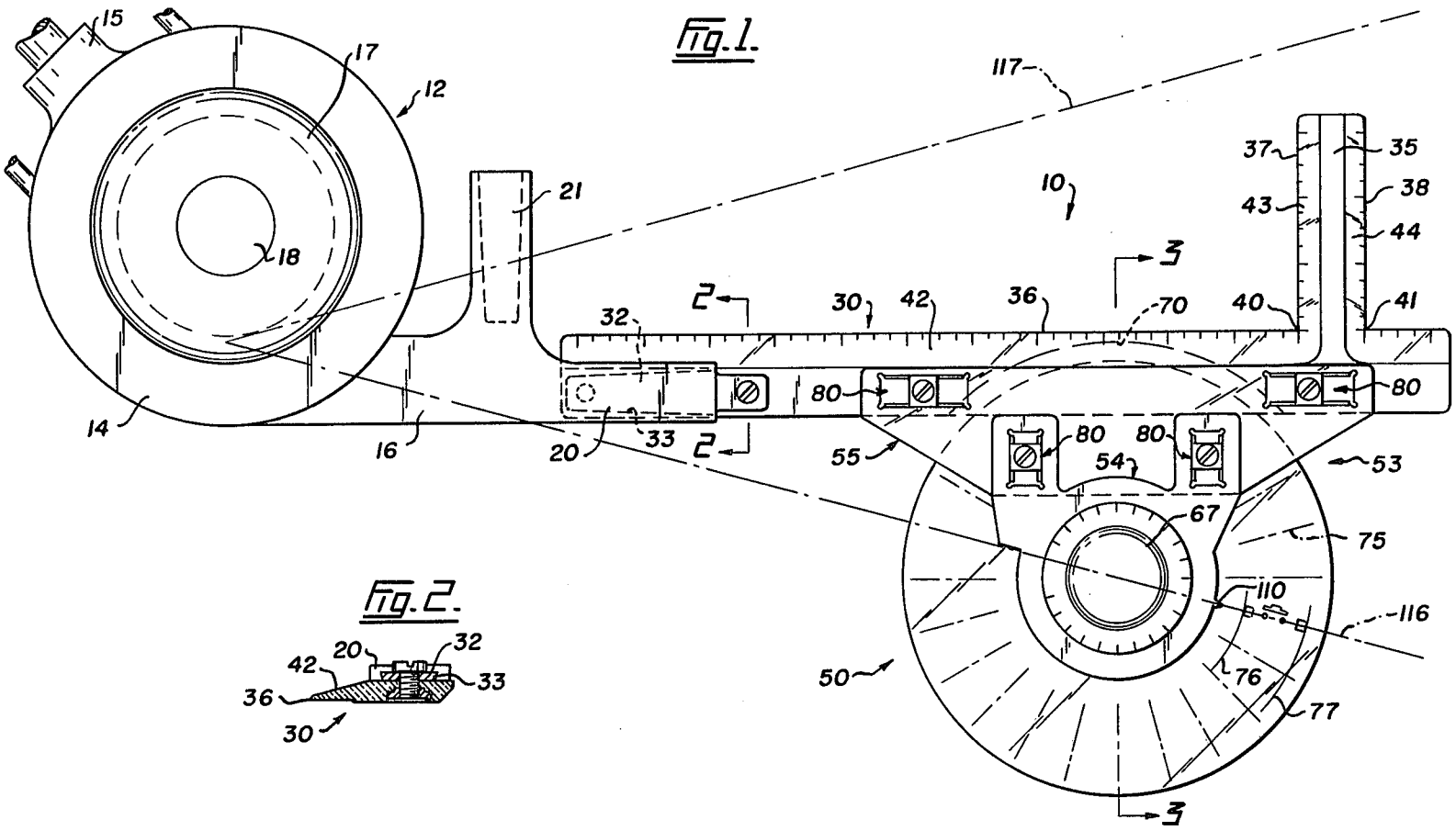
FIG. 1 is a plan view of the present drafting machine attachment.
FIG. 2 is a transverse section taken on the line 2—2 of FIG. 1 and showing a preferred type of connection for securing the attachment to the drafting machine.

Referring to the drawings, the numeral 10 in FIG. 1 indicates generally an attachment for a drafting machine constructed in accordance with the present invention. The attachment 10 is shown in FIG. 1 installed on a conventional drafting machine 12 which may be the type having a protractor head 14 mounted on a pantograph arm 15. A support bracket 16 is carried by the protractor head and this bracket can be moved around the circumference of the head by means of a control handle 17 which is fitted with a lock-release button 18. The bracket is provided with chucks 20 and 21 disposed at right angles to one another and these two chucks normally are fitted with the scales which enable vertical and horizontal lines to be drawn on the paper supported by the drawing board. By turning the control handle 17, a draftsman can adjust the machine 12 to draw lines at selected angles to the horizontal and vertical lines. The drafting machine also allows the draftsman to swing the head 14 and therefore the horizontal and vertical scales laterally across the drawing board as well as up and down thereon.

Figure 4:
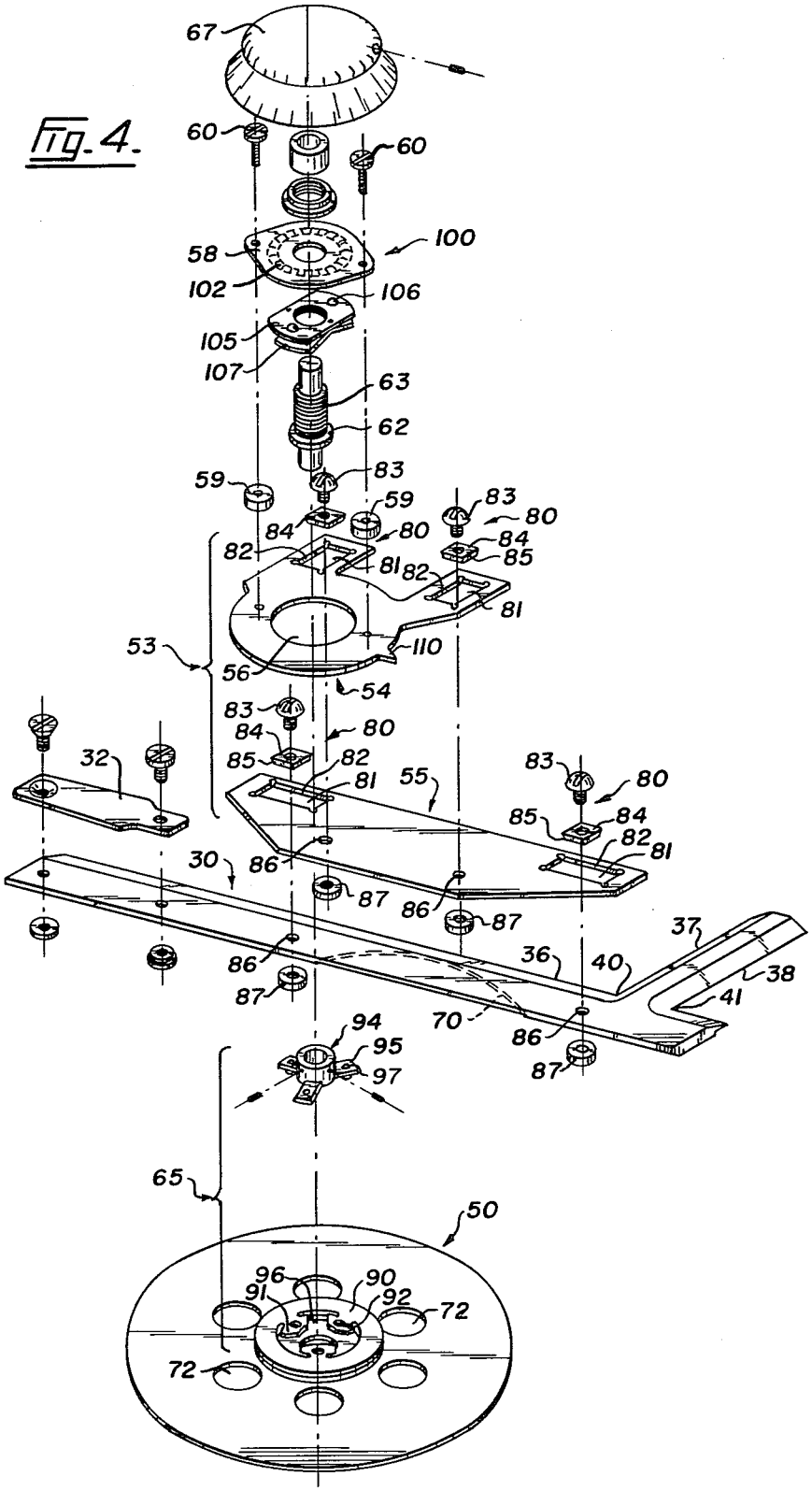
FIG. 4 is an exploded perspective view of the attachment.

The present attachment comprises a modified horizontal scale 30 which replaces the conventional scale normally carried by the chuck 20. A standard chuck plate 32, see FIGS. 1, 2 and 4, is used to secure the left or innermost end of the scale 30 to the chuck 20 since this type of connector is fitted to the corresponding ends of the horizontal and vertical scales normally employed on this particular machine. In order to receive the chuck plate 32, the chuck 20 has a tapered slot 33 which is shown by dotted lines in FIG. 1. The correspondingly tapered chuck plate 32 on the modified horizontal scale is pushed into this slot on the chuck 20 thereby securing the attachment 10 to the protractor head of the drafting machine.

The horizontal scale 30 is provided with a relatively short vertical extension 35. This extension is integrally formed with the horizontal scale and both parts preferably are made of a tough, transparent plastic. The extension is located near the right (FIG. 1) or distal end of the horizontal scale so as to project upwardly at right angles to a ruling edge 36 of the scale. Opposite side edges of the extension provide ruling edges 37 and 38 perpendicular to the edge 36. This provides the attachment with two index points designated 40 and 41 located at the junctions of the ruling edges. The horizontal scale has a bevelled face 42 near the ruling edge 36 and this face is shown graduated in inches starting at zero located at the index point 40 and extending a suitable distance to the left or connected end of the scale. The extension is one inch wide so another zero appears at the index point 41 and, to the right of the extension, there is a short portion (one inch) of the graduated bevelled edge 42. Nearer the ruling edges 37 and 38 of the extension, there are bevelled faces 43 and 44 which are graduated in inches starting at the zeros located at the index points 40 and 41 and extending to near the tip of the extension.

The two index points are used to locate marks on the drawing for the placement of symbols which are provided on a template 50 of transparent plastic. This circular template is mounted on the horizontal scale 30 by means which is shown to comprise a bracket 53 having two major parts 54 and 55. An opening 56 (FIG. 4) is formed in the bracket 54 and a plate 58 is supported above this opening on spacers 59 with screws 60 securing the plate and the spacers to the bracket part. The plate 58 carries a sleeve bearing 62 in which a shaft 63 is rotatably mounted and held against vertical movement. A coupling 65 connects the template 50 to the lower end of the shaft and a knob 67 is secured to the upper end of the shaft.

Thus, the mounting means provided by the bracket 53 and associated parts supports the template so that it can be rotated through 360° in either direction by turning the knob 67. The template normally is in sliding contact with the surface of a drawing fastened to the drawing board and, of course, so is the scale 30. It will be noticed particularly in FIG. 1 that the upper edge of the template underlaps the scale to some extent and, to accommodate this upper part of the template, the underside of the scale is provided with an arcuate recess 70.

Figure 5:
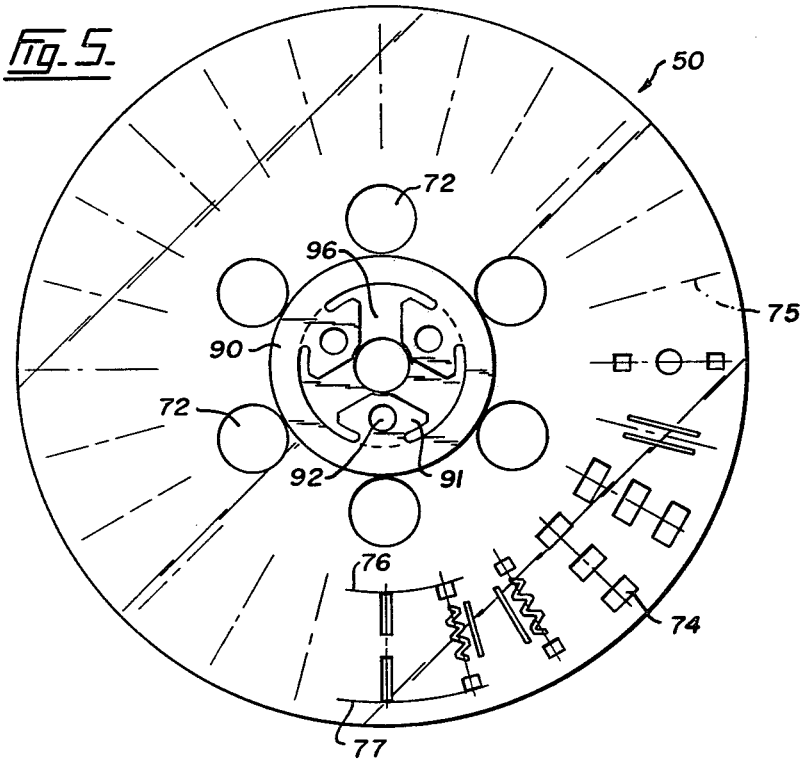
FIG. 5 is a plan view of a symbol template forming part of the attachment and showing a female portion of a coupling used to connect the symbol template to its turning shaft.

The template 50 has a number of finger openings 72 arranged around the coupling 65 as well as a very large number of holes or outlines 74, see particularly FIG. 5. These outlines are shaped to represent the various symbols which are so often used on a drawing and a draftsman simply inserts the tip of his pencil into an outline to employ it as a stencil. It should be noted the symbol outlines are located on radial lines 75 which are centered on the axis of rotation of the shaft 63. The innermost and outermost outlines 74 on the radial lines are also located on circular lines 76 and 77 which are concentric to the axis of rotation of the shaft as well as to the outer edge of this template. Since the outlines on the circular lines 76 and 77 must be precisely related to the index points 40 and 41, the present attachment is provided with means for adjusting the position of the shaft 63 in relation to the horizontal scale.

The required adjustment is achieved by forming the mounting bracket 53 of the two parts 54 and 55 and by securing the latter part to the top surface of the scale 30 using a pair of fasteners 80 which appear in FIGS. 1 and are shown in detail in FIG. 4. Each fastener extends through a substantially rectangular slot 81 formed in the part 55, the slot having bevelled side edges 82. A screw 83 is fitted with a rectangular washer 84 which is lodged in each slot, the washer having bevelled side edges 85 engaging the edges 82 of the slot. Each screw 83 extends through a hole 86 formed in the scale 30 and, beneath that scale, the screw is fitted with a nut 87 which is inserted into the plastic material. It will be apparent that the pair of fasteners 80 can be temporarily loosened to permit the bracket 55 to be adjusted lengthwise of the scale 30.

The bracket part 54 overlaps the bracket part 55 and the two bracket parts are secured together by a pair of fasteners 80 identical to the previously described fasteners and therefore having corresponding parts indicated by the same reference numerals. Thus, the bracket part 54 and the template 50 carried thereby can be adjusted towards and away from the scale 30 by means of this pair of fasteners. The combined adjustment provided on the bracket 53 allows the shaft 63 to be adjusted longitudinally and transversely of the scale when required so as to be positioned relative to the scale whereby the symbol outlines 74 on the template will be disposed in a position to be moved into register with the index points 40 and 41 as will be described in detail later.

Figure 6:
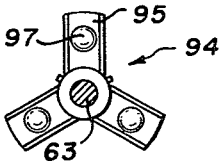
FIG. 6 is a part horizontal section and part plan view showing a male portion of the coupling.

The attachment 10 comes equipped with a set of templates each of which is provided with symbol outlines required for a particular drawing. This makes it important that the coupling generally indicated at 65 be one which is quick and easy to operate and therefore the coupling includes a ring 90 which is secured to the upper face of the template, see FIGS. 4 and 5. Integrally formed with this ring, are inwardly projecting spring tabs 91 which are spaced above the template. A hole 92 is formed near the inner end of each tab. The shaft 63 has a bayonet-type connector 94 secured to its lower end, the connector forming the male part of the coupling. Three radial prongs 95 are provided on the connector and these prongs are spaced apart to enter correspondingly spaced gaps 96 located between the spring tabs 91. The prongs are provided with rounded detents 97 which are shown best in FIG. 6.

When a template is selected for use by the draftsman, he supports that template with at least some of his fingers projecting upwardly through the holes 72. The ring 90 is mated with the connector 94 so that the prongs 95 enter the spaces 96 between the spring tabs. A partial turn is then given to the templates and this results in the prongs being forced beneath the tabs 91 until the detents 97 enter the holes 92 and resist further rotation. The template is then releasably secured to the shaft and can be turned therewith.

Figure 3:
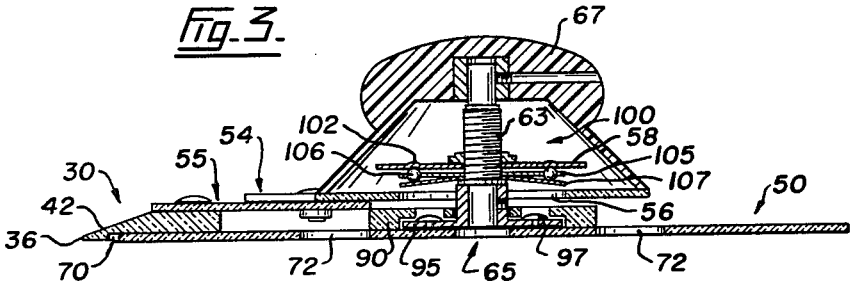
FIG. 3 is an enlarged transverse section taken on the line 3—3 of FIG. 1.

The present attachment is provided with indexing means 100 which enables a draftsman to locate a specific symbol which he wants to apply to his drawing. As shown best in FIGS. 3 and 4, the means 100 comprises a band of indents 102 which are formed on the plate 58. The indents making up this band are pressed into the underside of the metal plate at intervals corresponding to the spacing between the radial lines 75 on the template. Secured to the shaft 63 below the index plate, is a holder 105 for circumferentially spaced-apart ball bearings 106. A leaf spring 107 is secured to the holder and the outer ends of this spring bar against the ball bearings to press them into engagement with the indents 102. Thus, the template can be turned in a step-by-step motion. A pointer 110 is provided on the bracket part 54 and, every time the template comes to a halt, one of the radial lines 75 is brought into register with this pointer.

In operation, the draftsman may decide to place a symbol at the index point 40. This symbol will be assumed to be required on a horizontal line drawn against the ruling edge 36 and the draftsman marks this location with his pencil and then looks for the required symbol outline on the template 50. The outline 74 selected is moved by rotating the template to a position opposite the pointer 110 which is located on reference line 116 disposed 15° below the ruling edge 36. The attachment is then swung by operation of the protractor head 14 to a position which places the ruling edge 36 on a reference line 117 spaced 15° above the original position in which the ruling edge was drawn whereupon the required symbol outline comes into register with the marked index point. The symbol can then be outlined by the tip of the draftsmans pencil and the scale is then swung back to its original horizontal position allowing the draftsman to carry on with his drawing.

I claim:

1. An attachment for a drafting machine mountable on a drawing board and having a protractor head fitted with a chuck, said attachment comprising a scale adapted to be fitted to the chuck and located by operation of the protractor head in a first position and a second position disposed at a predetermined acute angle to said first position, said scale having a ruling edge and an index point on said edge usable when the scale is in the first position to mark the location for placement of a required symbol, a template having a plurality of symbol outlines, mounting means supporting the template on the scale for rotation about an axis perpendicular to the drawing board, and an indicator on the mounting means for locating a required symbol outline in a position to coincide with the marked location when the scale is moved to the second position.

2. An attachment as claimed in claim 1, in which said scale has an extension provided with a ruling edge perpendicular to the ruling edge on the scale and combining therewith to form the index point.

3. An attachment as claimed in claim 1, in which said mounting means includes a shaft having a lower end, and coupling means detachably securing the template to the lower end.

4. An attachment as claimed in claim 1, in which said scale has an extension near an outer end of the scale, said extension having parallel side edges providing ruling edges perpendicular to the ruling edge on the scale, said ruling edges of the extension combining with the ruling edge of the scale to form the first mentioned index point and a second index point spaced therefrom, and said symbol outlines being arranged on the template in concentric rows having a radial spacing equal to the spacing between the first and second index points.

5. An attachment as claimed in claim 4, in which said template has the symbol outlines additionally arranged in radial rows uniformly spaced apart, and an indexing device including a first member rotatable with the template and a second member non-rotatably supported by the mounting means, said first and second members co-operating to progressively bring the radial rows of symbol outlines into register with the indicator.

6. An attachment as claimed in claim 5, in which said scale and said extension are graduated in units of length adjacent their ruling edges commencing at the index points.

7. An attachment as claimed in claim 3, in which said mounting means additionally includes means for selectively adjusting the shaft longitudinally and transversely of the scale.

8. An attachment for a drafting machine mountable on a drawing board and having a protactor head fitted with a chuck, said attachment comprising a scale having an end member connectable to the chuck, said scale being operable by the protractor head to extend across the drawing board located in a first position and in a second position disposed at a predetermined acute angle to said first position, a ruling edge on the scale, an extension on the scale near an end remote from the end member, said extension having parallel side edges providing ruling edges perpendicular to the ruling edge on the scale, said ruling edges of the extension combining with the ruling edge of the scale to form a first index point and a second index point spaced therefrom, said first and second index points being usable to mark the locations of required symbols, a template having a plurality of symbol outlines, mounting means supporting the template on the scale for rotation about an axis perpendicular to the drawing board, said mounting means including a shaft having a lower end, coupling means detachably securing the template to the lower end of the shaft, said symbol outlines being arranged on the template in concentric rows having a radial spacing equal to the spacing between the first and second index points, said symbol outlines additionally being arranged in radial rows uniformly spaced apart, an indicator on the mounting means for locating a required symbol outline in a position to coincide with a marked location when the scale is moved to the second position, and an indexing device including a first member rotatable with the template and a second member non-rotatably supported by the mounting means, said first and second members co-operating to progressively bring the radial rows of symbol outlines into register with the indicator.

9. An attachment as claimed in claim 8, in which said mounting means comprises a bracket having a first part and a second part, means for adjusting the first and second bracket parts relative to one another to move the shaft transversely of the scale, and means securing the second bracket part to the scale allowing adjustment of the shaft longitudinally of the scale.

* * * * *